United States Patent [19]

Conder, Jr.

[11] Patent Number: 5,065,870

[45] Date of Patent: Nov. 19, 1991

[54] TACO HOLDER

[75] Inventor: O. Ray Conder, Jr., Charlotte, N.C.

[73] Assignee: Conder Enterprises, Inc., Charlotte, N.C.

[21] Appl. No.: 628,496

[22] Filed: Dec. 17, 1990

[51] Int. Cl.[5] ..... A47F 7/00

[52] U.S. Cl. ..... 211/13; D7/504; 248/174

[58] Field of Search ..... 248/176, 174; 211/13; D7/504, 554, 503

[56] References Cited

U.S. PATENT DOCUMENTS

| | | | |
|---|---|---|---|
| D. 263,191 | 3/1982 | Moore . | |
| D. 263,786 | 4/1982 | Kohan . | |
| D. 273,746 | 5/1984 | Hunt . | |
| D. 278,199 | 4/1985 | Richards . | |
| D. 279,160 | 6/1985 | Hunt | D7/504 |
| D. 279,851 | 7/1985 | Willis . | |
| D. 282,338 | 1/1986 | Putt . | |
| D. 294,670 | 3/1988 | Kurtz . | |
| D. 300,707 | 4/1989 | Walmesley . | |
| D. 310,462 | 9/1990 | Schoen | D7/504 |
| D. 310,611 | 9/1990 | Pittman . | |
| D. 312,374 | 11/1990 | Williams, Jr. | D7/504 |
| 1,821,313 | 9/1931 | Marsh | 248/174 X |
| 2,180,540 | 11/1939 | Moebus et al. | D7/504 X |
| 4,270,660 | 6/1981 | Putt | D7/504 X |
| 4,362,247 | 12/1982 | Rueda | 211/13 |
| 4,501,367 | 2/1985 | Potts | 211/13 |
| 4,573,570 | 3/1986 | Cortopassi . | |
| 4,603,825 | 8/1986 | Kotliar . | |
| 4,653,645 | 3/1987 | Thomas . | |
| 4,746,010 | 5/1988 | Fournier | D7/504 X |
| 4,872,566 | 10/1989 | Alsup | D7/504 X |

*Primary Examiner*—Ramon O. Ramirez

*Attorney, Agent, or Firm*—Bell, Seltzer, Park & Gibson

[57] ABSTRACT

A holder for supporting a taco shell in an upright position to prevent spillage of foodstuffs contained within the shell. The holder includes a base portion and a support portion which are shaped to resemble a Mexican sombrero. The holder is also designed for compact storage.

8 Claims, 2 Drawing Sheets

TACO HOLDER

FIELD OF THE INVENTION

The present invention relates to holders for supporting and serving tacos to consumers. In particular, the invention relates to a holder especially adapted for use in a fast food restaurant to support a taco with its opening in a substantially upright position for minimizing spillage of the fillings contained within the taco shell.

BACKGROUND OF THE INVENTION

A taco is a mexican food item which is made from a taco shell and various fillings. A taco shell is usually a brittle shell formed from a cooked circular cornmeal cake that has been folded over into a U-shape. Various filling materials, such as ground beef, shredded lettuce, chopped onions, tomatoes, grated cheese, or other foodstuffs are placed within the taco shell, and various sauces may also be added to enhance the spicy mexican flavor of the taco.

The taco fillings frequently fall from the openings of the taco shell, especially if the filled taco is laid on its side. Moreover, because a taco shell is characteristically brittle, the fillings within the taco shell are easily released if the shell is crushed or broken. Thus, service of a taco to a diner and the subsequent consumption of the taco can be a messy, often clumsy process. Nonetheless, tacos have become popular food items, and are commonly found on the menus of many fast food restaurants. In this environment, tacos are usually presented to the customer with the taco shell prefilled with some or all of the filling materials. Thus, it is desirable to provide some means for supporting a filled taco shell when it is served to a consumer to alleviate spillage of the filling materials.

The foregoing is particularly important for fast food outlets, in which service time is at a premium. To ensure customer satisfaction, the unique requirements of fast food restaurant service necessitate that the taco holder be sturdy, lightweight, compact, inexpensive, and disposable. Also, as it is likely that a fast food restaurant will serve a large quantity of tacos per unit time, it is desirable that the taco holder be capable of compact storage to accommodate the space restrictions common to most popular franchise fast food restaurants and to ensure that a large number of the holders will be readily accessible to restaurant workers. Additionally, it is desirable that the taco holder reflect a mexican motif in keeping with the decorative scheme promoted at many taco serving restaurants.

In light of the aforementioned deficiencies, it is an object of the present invention to provide a new, disposable taco holder that gives broad, sturdy support to retain a taco shell in an upright position.

Another object of the present invention is to provide a holder that will support a filled taco shell to prevent spillage of the fillings within the shell.

Yet another object of the present invention is to provide a taco holder that may be stored compactly.

A further object of the present invention is to provide a taco holder having a mexican motif.

SUMMARY OF THE INVENTION

The above and other objects and advantages of the present invention are achieved in the embodiments described herein by the provision of a taco holder which comprises a generally circular, flat base and a tubular support portion affixed to and extending upwardly from a central portion of the base. The support portion has a slot extending laterally therethrough and extending downwardly from the upper free end of the support portion for a substantial portion of the support portion. The slot defines a pair of transversely aligned, generally U-shaped edge surfaces which are adapted to support a taco shell. In a preferred embodiment, the taco holder has an unitary plastic construction and may be nestable for storage. In another preferred embodiment, the taco holder may be stored flat by means of a series of slits along the junction of the base and support portion and preformed creases along the base and support portion which cooperate such that the base and support portion may be folded.

BRIEF DESCRIPTION OF THE DRAWINGS

The foregoing and other objects, advantages and features of the invention, and the manner in which the same are accomplished, will become more readily apparent upon consideration of the following detailed description of the invention taken in conjunction with the accompanying drawings, which illustrate preferred and exemplary embodiments and wherein.

DESCRIPTION OF THE PREFERRED EMBODIMENTS

Figure 1:
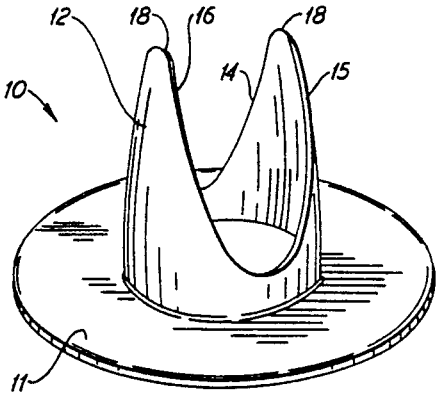
FIG. 1 is a perspective view of one preferred embodiment of a taco holder made in accordance with the present invention.

Referring now to the drawings, FIG. 1 is a perspective view of one preferred embodiment of a taco holder made in accordance with the present invention, designated generally at 10. As shown therein and in FIG. 3, the resemblance of the taco holder 10 to a mexican sombrero is readily apparent. Surface decoration may also be applied to the taco holder 10 to enhance the sombrero-like appearance and mexican motif.

Figure 2:
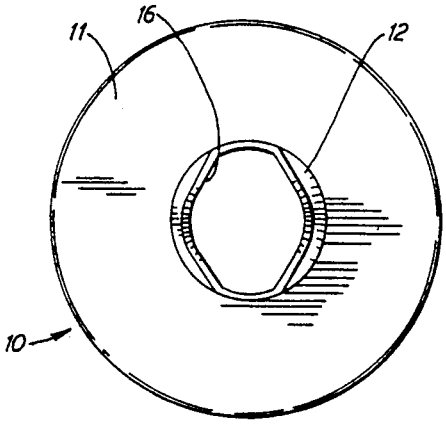
FIG. 2 is a top plan view thereof.

The taco holder 10 includes a broad, generally flat base 11 and an upwardly protruding support portion 12. As best shown in FIG. 2, the base 11 is a flat, circular surface. In the preferred embodiments, the base 11 may be shaped to resemble the brim of a mexican sombrero.

Figure 3:
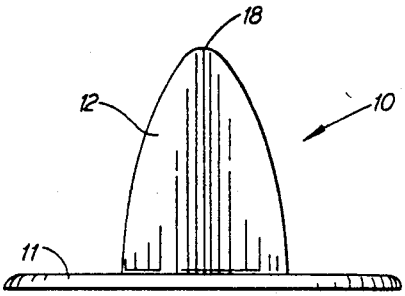
FIG. 3 is front elevation view thereof.

The support portion 12 extends upwardly from a central portion of the base 11 and has an upper free end 18. In a preferred embodiment, the support portion 12 is hollow, and the base 11 is open in the area within the support portion 12. The support portion 12 may be tubular in shape and has a slot 16 extending laterally therethrough. The slot 16 extends downwardly from the upper end 18 for at least as substantial portion of the support portion 12. As best shown in FIGS. 1 and 3, the support portion 12 is generally frusto-conical in shape, and the slot 16 defines a pair of transversely aligned, generally U-shaped edge surfaces 14 and 15.

Figure 4:
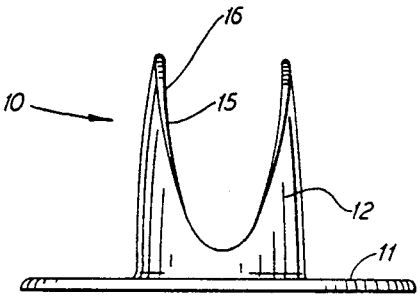
FIG. 4 is a side elevation view thereof.

In a preferred embodiment, the base 11 is about 2 ½ inches in diameter, and the support portion 12 is about 1½ inches high. FIGS. 3 and 4 further illustrate this first embodiment of the invention.

Figure 5:
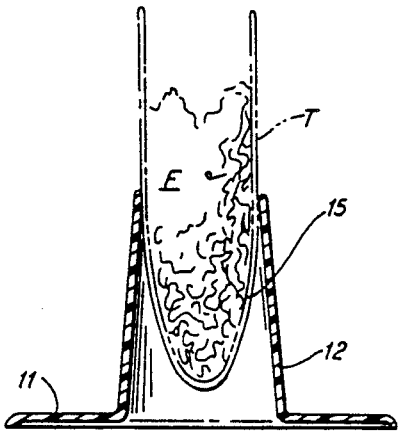
FIG. 5 is a cross section view of the side of the taco holder shows a filled taco shell supported in the upright position.

The U-shaped edge surfaces 14 and 15 are adapted to collectively support the exterior surface of a taco shell. As shown in FIG. 5, a taco shell T may be inserted between the edge surfaces 14 and 15 such that the support portion 12 retains the shell T in an upright position. Thus, the shell T is supported by the taco holder 10 such that fillings F are retained therein. In a preferred embodiment, the U-shaped edge surfaces 14 and 15 smoothly merge with each other at the upper free end 18 of the support portion 12 so as to form a pair of smoothly rounded, opposing peaks at the upper free end 18.

Figure 6:
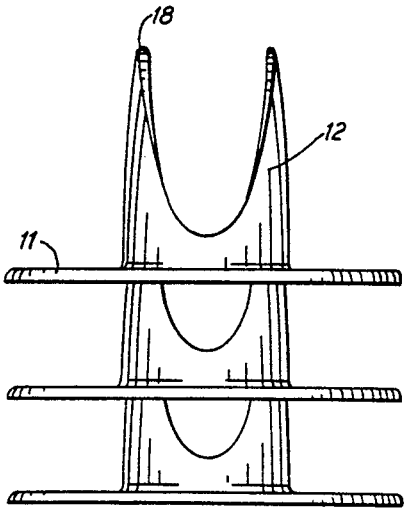
FIG. 6 is a side elevation view of three taco holders made in accordance with the present invention stored in a nested configuration.

FIG. 6 shows three of the taco holders nested together by insertion of the upper free end 18 of support portion 12 of a taco holder 10 within the open interior of the base 11 and support portion 12 of another taco holder 10. Such nesting allows successive taco holders 10 to be placed adjacent and parallel each other, thereby facilitating storage of a large number of holders 10 in a relatively small space.

Figure 7:
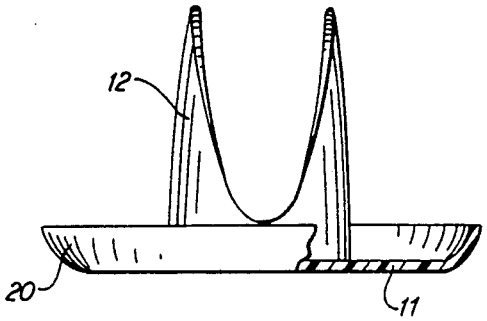
FIG. 7 is a side elevation view of a second embodiment of the present invention.
Figure 8:
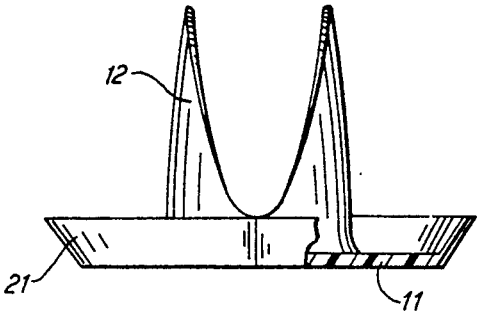
FIG. 8 is a side elevation view of a third embodiment of the present invention.
Figure 9:
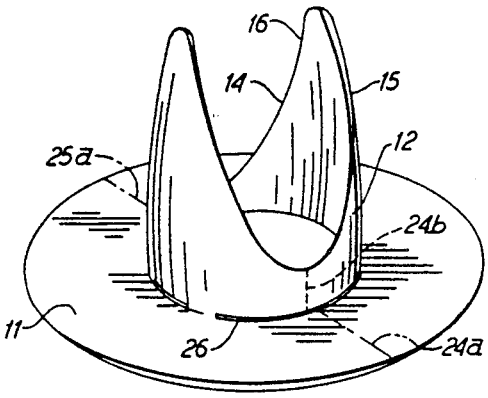
FIG. 9 is a perspective view of a fourth embodiment of the present invention.

FIGS. 7 and 8 show alternative embodiments of the taco holder 10 of the present invention which include an upwardly turned rim 20 or 21, respectively, which encircles the periphery of the base 11. The rims 20 and 21 further simulate the sombrero like appearance of the taco holder and also provide additional support to the bottom portion of a taco shell. In one preferred embodiment, as shown in FIG. 8, the rim 21 is straight in the vertical plane and forms a sharp angle of about 100° with the base 11. The rim 20 shown in FIG. 7, however, forms a gradual curve upward from the base 11. In the preferred embodiments, the rims 20 or 21 may extend upward from about 3/16 to ¼ inch above the base 11.

The taco holder 10 may be made of a suitable material, including, as in one preferred embodiment, molded plastic. In another preferred embodiment, the holder 10 is made of light cardboard or stiff paper. Alternatively, it is believed that the holder 10 could be successfully made from wood, clay, or other clay-based materials such as bisque, ceramic, porcelain, terra cotta, and china. In a preferred embodiment, the taco holder 10 should be inexpensive and disposable so that it may be used in a typical fast food restaurant environment. It is believed that use of any of the materials noted above will achieve these ends. However, it is also envisioned that the taco holder may not be disposable in some applications, and thus, that it may also be adapted for reuse.

Figure 10:
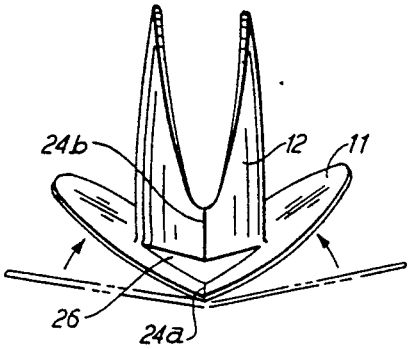
FIG. 10 is a side elevation view thereof which shows a partially folded taco holder.
Figure 11:
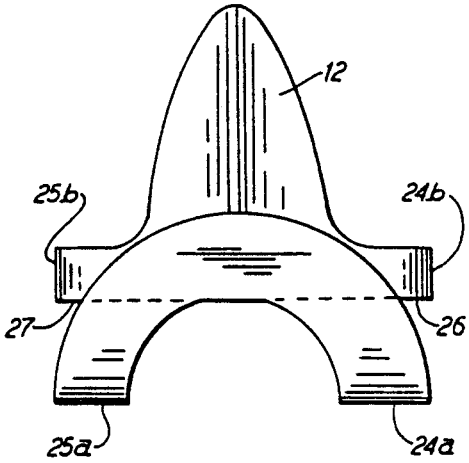
FIG. 11 is a front view thereof which shows a fully folded taco holder.
Figure 12:
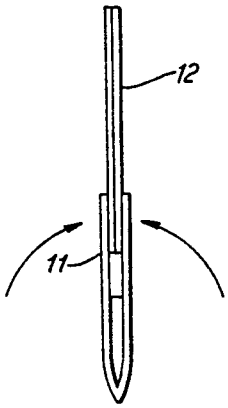
FIG. 12 is a side view thereof which shows a fully folded taco holder.

In another preferred embodiment shown in FIG. 9 through 12, the taco holder 10 may be folded flat for storage. In this embodiment a series of base creases **24*a*, 25*a*, support creases 24*b*, 25*b*, and slits 26, 27 cooperate such that the support portion 12 may be collapsed to a position parallel to the base 11, while the base 11 simultaneously folds in half. The pair of slits 26, 27 extend along a portion of the junction of the support portion 12 and the central portion of the base 11 and respectively beneath the lower regions of U-shaped edge surfaces 14 and 15. The slots 26, 27 do not extend along the joinder of the base 11 and support portion 12 beneath the tallest regions of support portion 12. A pair of preformed base Creases 24*a* and 25*a* are formed in the base 11 and extend radially across the base 11 on opposing sides thereof and respectively beneath the lower regions of the U-shaped edge surfaces 14 and 15 on each side of the support portion 12. Aligned with base creases 24*a* and 25*a* are support creases 24*b* and 25*b*, which extend generally vertically up the lateral sides of the support portion 12 beneath lower regions of the associated U-shaped edge surfaces 14 and 15. As shown in FIG. 10, upward folding of the base 11 about the base creases 24*a* and 25*a* opens slits 26, 27. The segments of base 11 affixed to the support portion 12 beneath the tallest portions of support portion 12 act as hinges. The support portion 12 also flattens by folding along support creases 24*b* and 25*b*. As shown in FIGS. 11 and 12, continued folding of the taco holder 10** causes the holder to assume a flat orientation for storage.

In the drawings and specification, there have been disclosed typical preferred embodiments of the invention. Although specific terms have been employed, they have been used in a generic and descriptive sense only and not for purposes of limitation, the scope of the invention being set forth in the following claims.

That which I claim is:

1. A taco holder which is adapted for receiving a taco shell and supporting the same in a substantially upright position to prevent inadvertent spillage of filling materials contained within the shell, comprising:

a generally circular, flat base; and a tubular support portion affixed to and extending upwardly from a central portion of said base, said support portion having a generally frusto-conical configuration defining an upper free end and having a slot extending laterally therethrough and which extends downwardly from said upper free end for at least a substantial portion of the height of said support portion, and such that said slot defines a pair of transversely aligned, generally U-shaped edge surfaces which are adapted to collectively support a taco shell thereupon, wherein said base is open in the area within said support portion, so as to permit nesting of a plurality of said taco holders for compact storage.

2. The taco holder as defined in claim 1 wherein said taco holder is made of a material selected from the group consisting of molded plastic, light cardboard, stiff paper, ceramic, porcelain, terra cotta, china, and bisque.

3. The taco holder as defined in claim 1 wherein said pair of U-shaped edge surfaces smoothly merge with each other at said upper free end of said support portion and so as to form a pair of smoothly rounded, opposing peaks at said upper free end.

4. The taco holder as defined in claim 1 wherein said base further comprises a curved, upwardly extending rim encircling the periphery thereof.

5. The taco holder as defined in claim 1 wherein said base further comprises a straight, upwardly extending rim encircling the periphery thereof.

6. A taco holder which is adapted for receiving a taco shell and supporting the same in a substantially upright position to prevent inadvertent spillage of filling materials contained within the shell, comprising:

a generally circular, flat base;

a tubular support portion affixed to and extending upwardly from a central portion of said base, said support portion defining an upper free end and having a slot extending laterally therethrough and which extends downwardly from said upper free end for at least a substantial portion of the height of said support portion, and such that said slot defines a pair of transversely aligned, generally U-shaped edge surfaces which are adapted to collectively support a taco shell therein;

a pair of slits extending along a portion of the junction between said central portion of said base and said support portion and such that said slits are respectively positioned beneath lower regions of said U-shaped edge surfaces in said support portion;

a pair of preformed base creases formed in said base and extending radially across said base on opposing sides thereof and respectively beneath the lower regions of said U-shaped edge surfaces; and a pair of preformed support creases formed in said support portion and aligned with respective ones of said base creases and extending generally vertically upwardly from said base to the lower region of the associated U-shaped edge surface in said support portion, whereby said taco holder may be folded flat through cooperation of said creases and said slits for compact storage.

7. A taco holder as defined in claim 6 wherein said pair of U-shaped edge surfaces smoothly merge with each other at said upper free end of said support portion and so as to form a pair of smoothly rounded, opposing peaks at said upper free end.

8. A taco holder as defined in claim 6 wherein said taco holder is made of stiff paper.

* * * * *